US005489968A

United States Patent [19]

Rossbach et al.

[11] Patent Number: 5,489,968

[45] Date of Patent: Feb. 6, 1996

[54] COPY SHEET PURGE PROCESSING DEVICE

[75] Inventors: Joel A. Rossbach; Joel L. Respress; Barbara Monahan, all of Rochester, N.Y.; Eduardo I. Antonio, Gardena, Calif.

[73] Assignee: Xerox Corporation, Stamford, Conn.

[21] Appl. No.: 177,027

[22] Filed: Jan. 4, 1994

[51] Int. Cl.[6] ..... G03G 13/00

[52] U.S. Cl. ..... 355/203; 355/208

[58] Field of Search ..... 355/203, 207, 355/208

[56] References Cited

U.S. PATENT DOCUMENTS 4,497,569 2/1985 Booth, Sr. ..... 355/206
4,796,055 1/1989 Takano et al. ..... 355/206 X
5,257,070 10/1993 Miller et al. ..... 355/208 X
5,276,495 1/1994 Maruta et al. ..... 355/313

*Primary Examiner*—Nestor R. Ramirez
*Attorney, Agent, or Firm*—Ronald F. Chapuran

[57] ABSTRACT

The method of purging undesirable copy sheets from an image processing apparatus having a xerographic process for producing images on copy sheets, the apparatus including a plurality of copy sheet sources, a copy sheet drive, a purged copy sheet location, and a controller for directing the xerographic process, including the steps of monitoring the timer for a given time period; detecting by the controller said given time period; checking the copy sheet sources for the presence of a purgeable copy sheet; responding to the detection of said given time period and the checking of the copy sheet sources to operate the copy sheet drive, and purging undesirable copy sheets to the purged copy sheet location.

27 Claims, 5 Drawing Sheets

COPY SHEET PURGE PROCESSING DEVICE

BACKGROUND OF THE INVENTION

The invention relates to copy quality and, more particularly, to eliminating deletions and residual fuser oil contamination from xerographic prints.

In using reproduction machines, there are various types of system shut downs, cycle downs, or malfunctions that can occur in a variety of operating modes. Operator involvement in returning the machine to a print quality status can often be extensive particularly in machines with various accessories such as sorters, collators, finishers and document handlers. The problem of maintaining the integrity of the run in process, and minimizing down time and operator involvement can be significant.

In particular, defects in output copies may be caused by machine activity. For example, defects on copy sheets, typically deletions, may be found on prints or copies made on sheets that have been pre-fed in the paper trays and have remained in that position long enough to have acquired a curl. Also, when the system has remained idle for some length of time, the first prints or copies out, whether or not the sheet s have been pre-fed, may exhibit contamination by excess fuser lubricant that has accumulated in the fuser mechanism (on the fuser roll). The amount of elapsed time required for these effects to develop varies and is dependent upon several factors. Those factors may include environmental conditions, materials used, and type of system.

One or both of these effects may or not be a problem for the customer. Both conditions could occur during standby or power down. The amount of time may vary from as little as 30 minutes to 4 hours. Sensitivity by the customer to these effects may vary upon the criticality of the print or copy jobs. For example, accounting or internal administrative sheets of low importance may be the first sheets through the system in specific job sets. Another factor affecting sensitivity may be the use of special stock in one or more trays which must be fed in specific sequence and the invocation of the feature may cause disruption to the copy process. Such disruption may occur with multipart forms, such as carbonless, certificates, etc., or numbered stock, such as checks, stock certificates, etc., or any other stock that must be fed in sequence from one or more trays.

Job recovery in a copy sheet jam environment is well known in the prior art and generally requires the removal of documents or copy sheets stopped in several places in the machine. Jam recovery also often requires the reordering of documents as well as the purging of some or all of copies in process in the machine. For example, U.S. Pat. No. 5,142,340, assigned to the same assignee as the present invention, discloses the automatic purge of copy sheets through the fuser after a jam to rid the system of potentially contaminating materials.

Various other techniques of jam clearance exist in the prior art. For example, U.S. Pat. No. 4,627,711 to Schron, assigned to Xerox Corporation, discloses a control system for controlling the shutdown of a paper path system in a copy machine when a paper handling fault occurs. Upon detecting a malfunction or jam, the control system evaluates the status of all sheets in a sheet handling system and makes determinations whether to hold sheets from entering into a boundary between two zones or to drive a sheet at a boundary into a next zone.

U.S. Pat. No. 4,786,041 to Acquaviva et al., assigned to Xerox Corporation, discloses a document handler jam clearance and job recovery system. Upon the occurrence of a paper jam, the system determines whether a document has jammed in a first, second or third document path jam zone and automatically provides a preliminary job recovery operation before the document handler is fully stopped. Document feeding zones are independently operated to feed unjammed documents in a third jam zone to a stacking tray or to feed unjammed documents in the third jam zone to a stacking tray or to feed unjammed documents in the first jam zone to a platen, so that documents are directed to be operator removed from only one zone.

U.S. Pat. No. 4,275,879 to Yamashita et al. discloses an apparatus for detecting an abnormal paper feed. Upon detecting the occurrence of an abnormal paper feed, the apparatus sends forth an abnormality signal only after all preceding sheets have been processed and delivered to an output stacker from entering into a boundary between two zones or to drive a sheet at a boundary into a next zone.

One deficiency in these prior art devices is the restriction of the system recovery to fault and jam recovery. Another difficulty in prior art devices is the inability to account for multiple non jam occurrences such as fuser oil contamination and copy sheet curl and to take corrective measures. Another difficulty is the lack of the capability to optionally or selectively monitor various system parameters for purging unwanted copy sheets.

It is an object, therefore, of the present invention to be able to adapt a given machine to a specific operating environment to be able to purge copy sheets from the system unrelated to a copy sheet jam event. Another object of the present invention is to be able to monitor system parameters such as machine down time or copy sheets in pre-feed rolls to purge the system of undesirable copy sheets. Another object of the present invention is provide the option to enable various machine parameters to purge undesirable copy sheets from the system unrelated to a copy sheet jam event. Other advantages of the present invention will become apparent as the following description proceeds, and the features characterizing the invention will be pointed out with particularity in the claims annexed to and forming a part of this specification.

SUMMARY OF THE INVENTION

A method of purging undesirable copy sheets from an image processing apparatus having a xerographic process for producing images on copy sheets including the steps of monitoring the xerographic process for a given xerographic parameter; detecting the xerographic parameter; responding to the detection of the xerographic parameter to operate a copy sheet drive, and purging the undesirable copy sheets to a purged copy sheet location. Specifically, a machine down time clock and copy sheet pre-feed stations are monitored and the method includes the option to inactivate the purging feature.

For a better understanding of the present invention, reference may be had to the accompanying drawings wherein the same reference numerals have been applied to like parts and wherein:

DETAILED DESCRIPTION OF THE DRAWINGS

DETAILED DESCRIPTION OF THE PREFERRED EMBODIMENT

Figure 1:
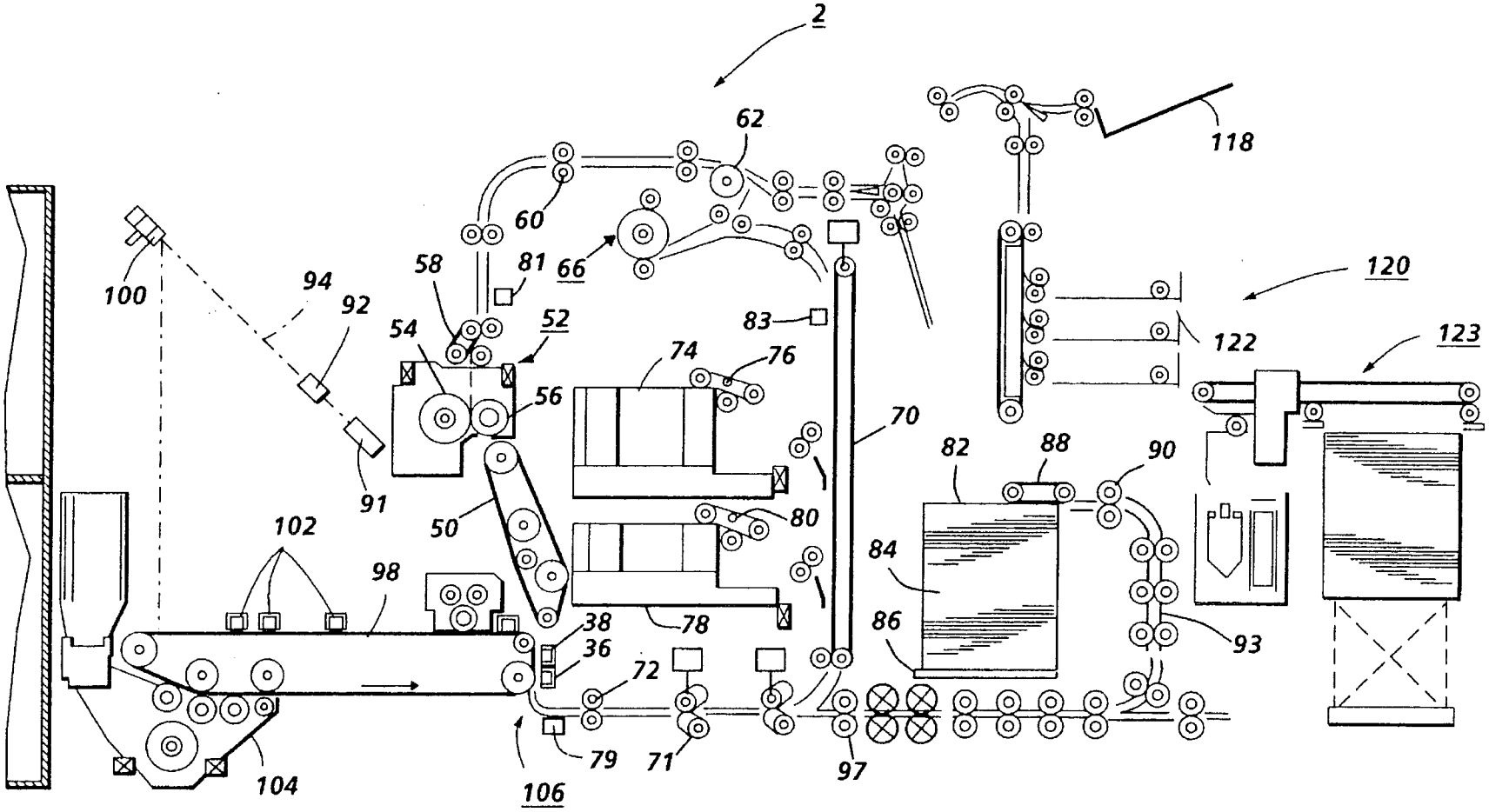
FIG. 1 is a plan view illustrating the principal mechanical components of a typical printing system incorporating the present invention.

Referring to FIG. 1, there is shown an exemplary laser based printing system 2 for processing print jobs in accordance with the teachings of the present invention. Printing system 2 for purposes of explanation is divided into a controller section and a printer section. While a specific printing system is shown and described, the present invention may be used with other types of printing systems such as ink jet, ionographic, etc.

The printer section comprises a laser type printer and for purposes of explanation is separated into a Raster Output Scanner (ROS) section, Print Module Section, Paper Supply section, and Finisher. The ROS has a laser 91, the beam of which is split into two imaging beams 94. Each beam 94 is modulated in accordance with the content of an image signal input by acousto-optic modulator 92 to provide dual imaging beams 94. Beams 94 are scanned across a moving photoreceptor 98 of the Print Module by the mirrored facets of a rotating polygon 100 to expose two image lines on photoreceptor 98 with each scan and create the latent electrostatic images represented by the image signal input to modulator 92. Photoreceptor 98 is uniformly charged by corotrons 102 at a charging station preparatory to exposure by imaging beams 94. The latent electrostatic images are developed by developer 104 and transferred at transfer station 106 to print media delivered by the Paper Supply section. Print media, as will appear, may comprise any of a variety of sheet sizes, types, and colors. For transfer, the print media or copy sheet is brought forward in timed registration with the developed image on photoreceptor 98 from either a main paper tray high capacity feeder 82 or from auxiliary or secondary paper trays 74 or 78.

A copy sheet is provided via de-skew rollers 71 and copy sheet feed roller 72. Sensor 79 detects the absence or presence of a copy sheet leaving roller 72. At the transfer station 106, the photoconductive belt 98 is exposed to a pre-transfer light from a lamp (not shown) to reduce the attraction between photoconductive belt and the toner powder image. Next, a corona generating device 36 charges the copy sheet to the proper magnitude and polarity so that the copy sheet is tacked to photoconductive belt and the toner powder image attracted from the photoconductive belt to the copy sheet. After transfer, corona generator 38 charges the copy sheet to the opposite polarity to detack the copy sheet from belt.

Following transfer, a conveyor 50 advances the copy sheet bearing the transferred image to the fusing station where a fuser assembly indicated generally by the reference numeral 52 permanently affixes the toner powder image to the copy sheet. Preferably, fuser assembly 52 includes a heated fuser roller 54 and a pressure roller 56 with the powder image on the copy sheet contacting fuser roller 54.

After fusing, the copy sheets are fed through a decurler 58 to remove any curl. Sensor 81 detects the absence or presence of a copy sheet leaving fuser 52. Forwarding rollers 60 then advance the sheet via duplex turn roll 62 to a gate which guides the sheet to output tray 118, finishing station 120 or to duplex inverter 66. The duplex inverter 66 provides a temporary wait station for each sheet that has been printed on one side and on which an image will be subsequently printed on the opposite side. Each sheet is held in the duplex inverter 66 face down until feed time occurs.

To complete duplex copying, the simplex sheet in the inverter 66 is fed back to the transfer station 106 via conveyor 70, de-skew rollers 71 and paper feed rollers 72 for transfer of the second toner powder image to the opposed sides of the copy sheets. Sensor 83 detects the absence or presence of a copy sheet leaving inverter 66. It should be noted that various other suitable sensors distributed throughout the copy sheet path to detect appropriate copy sheet distribution are contemplated within the scope of the present invention and sensors 79, 81, and 83 are merely illustrative. The duplex sheet is then fed through the same path as the simplex sheet to be advanced to the finishing station which includes a stitcher and a thermal binder.

Copy sheets are supplied from the secondary tray 74 by sheet feeder 76 or from secondary tray 78 by sheet feeder 80. Sheet feeders 76, 80 are friction retard feeders utilizing a feed belt and take-away rolls to advance successive copy sheets to transport 70 which advances the sheets to rolls 72 and then to the transfer station.

A high capacity feeder 82 is the primary source of copy sheets. Tray 84 of feeder 82 is supported on an elevator 86 for up and down movement and has a vacuum feed belt 88 to feed successive uppermost sheets from the stack of sheets in tray 84 to a take away drive roll 90. Roll 90 guides the sheet onto transport 93 which in cooperation with paper feed roller 97 moves the sheet to the transfer station via de-skew rollers 71 and feed rollers 72.

Figure 2A:
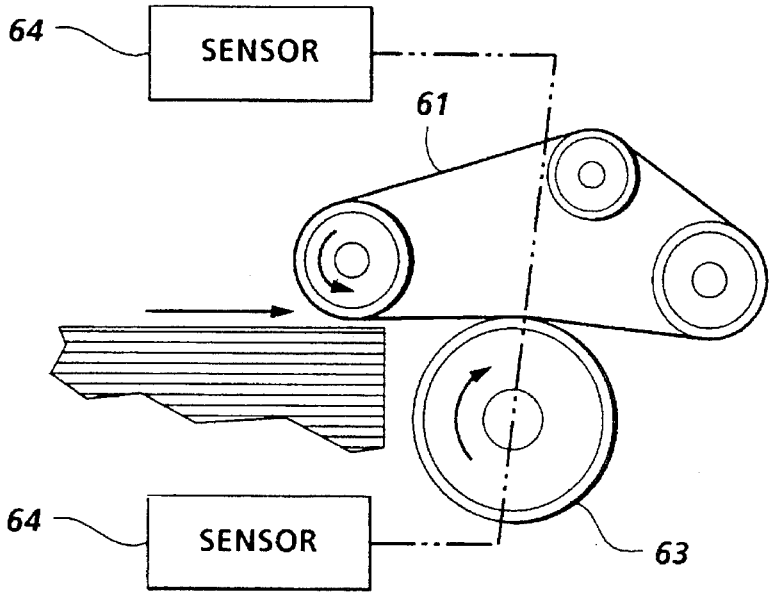
FIGS. 2A and 2B are an expanded view of typical copy sheet source pre-feed rolls in accordance with the present invention.
Figure 2B:
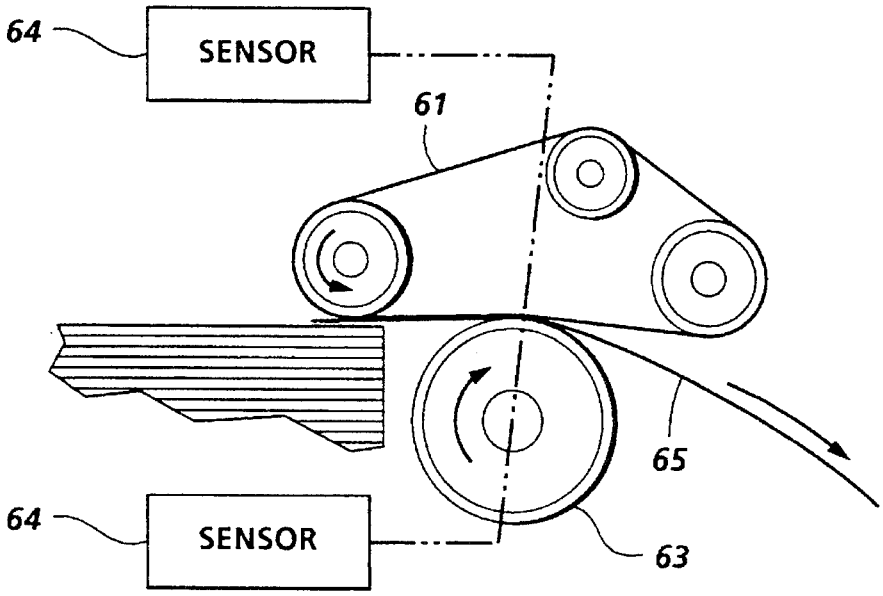

Sheet feeders 76 and 80 in FIG. 1 generally illustrate a feed belt and take away rolls to advance copy sheets to transport 70. A more detailed sheet feeder is illustrated in FIGS. 2A and 2B to show the positioning of a copy sheet at a pre-feed station in accordance with the present invention. For example, a copy sheet advanced from the tray 74 is engaged in the nip of feed belt 61 and retard roll 63 in an area generally known as the pre-feed station. A copy sheet that has been separated from the paper stack in tray 74 and moved to the pre-feed station, will be detected by sensor 64. FIG. 2A illustrates no copy sheet in communication with the sensor 64 and FIG. 2B illustrates a copy sheet 65 being detected by the sensor 64. After the sensor 64 detects a copy sheet at the pre-feed station, the sheet stops at the pre-feed station until the control logic generates a feed signal to advance the copy sheet to transport 70 which in turn advances a copy sheet to the rolls 72 and then to the transfer station 106.

The detection of copy sheet 65 by sensor 64 resulting in the positioning or stopping of the copy sheet in the nip of the feed belt 61 and retard roll 63 is known as the pre-feed operation. As illustrated in FIG. 2B, a pre-fed sheet such as sheet 65 becomes wrapped or curled over the retard roll 63 after introducing an undesirable and objectionable curl in the copy sheet. Such curled or warped copy sheets advancing through the transfer station often result in undesirable copy quality caused by toner deletion in the transfer process. In accordance with the present invention, it is necessary to purge such undesirable copy sheets from any copy sheet sources such as trays 74 and 78 and from feeder 82 prior to the initiation of a copy run in order to prevent the reproduction of undesirable copies. This is accomplished by monitoring each of the pre-feed stations at selected times during machine operation to selectively purge or eliminate potentially undesirable copy sheets. Such sheets must be purged as part of the purging of copy sheets that may exhibit contamination from excess fuser lubricant that has accumulated in the fuser mechanism while the machine is in an idle or inactive state.

Figure 3:
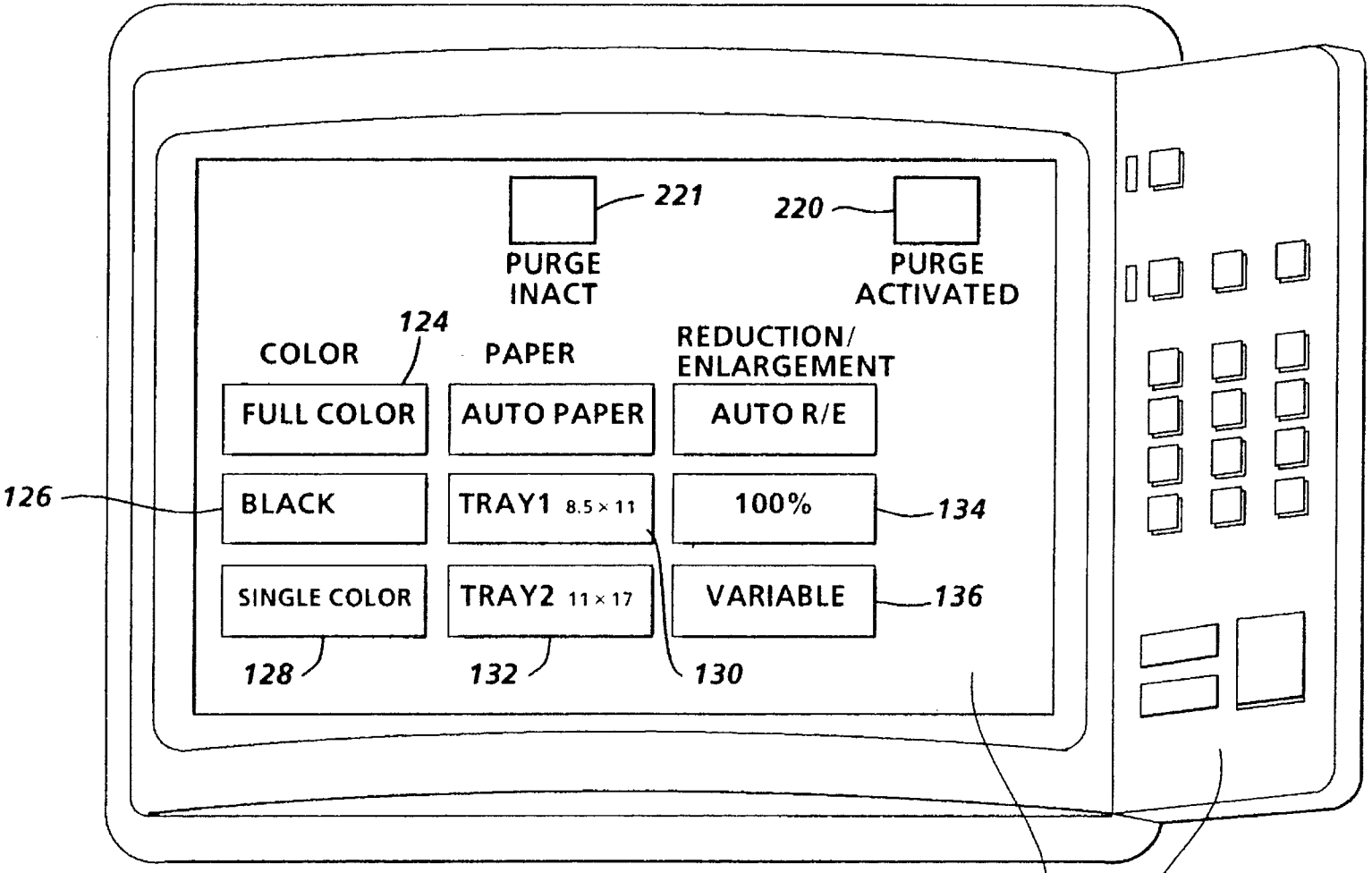
FIG. 3 illustrates a typical screen display interface forming a part of the control of the machine in FIG. 1.

With reference to FIG. 3, there is shown a typical user interface screen display for use in controlling a machine such as shown in FIG. 1. In particular, a display unit 51 and hardware control panel 52 illustrate various soft control buttons such as full color 124, black 126, single color 128, tray 1 (130), tray 2 (132), and auto reduction/enlargement including 100% (134) and variable 136.

The machine operator, as is well known, is able to set up or program the next job or a future machine job by the touch screen 51 in FIG. 3. That is, by suitable selection of displayed features, a job can be programmed such as full color, black, or single color, or a particular size paper such as tray 1 containing 8.5×11" copy sheets or tray 2 containing 11×17" copy sheets, or select a particular reduction/enlargement mode for example, 100% or variable.

It should be understood that the screen 51 of FIG. 3 is exemplary of typical display screens at user interfaces and that additional soft buttons can be displayed in the same frame or subsequent frames and can be selectively engaged by the operator or service representative. Also there can be a selection of suitable hard buttons shown on the panel 52. For example, either hard or soft buttons can be used to select full size copies, 94% size copies, 77% size copies or any variable size copy as well as buttons to engage a recirculating document feeder to operate in a collate mode or non-collate mode. In addition, suitable buttons can enable the user or service representative to select, in a given machine environment, finisher operations such as stapled, non-stapled, non-collated, and such features as duplex copying and offset stacking and to perform various recording and diagnostic operations. For details of typical user interface and screen controls, reference is made to U.S. Pat. Nos. 5,224,207 and 5,218,456 incorporated herein.

In accordance with the present invention, with reference to FIG. 3, there is shown a purge activate button 220 and purge inactivate button 221 to be able to pre-set purge conditions. It should be understood that buttons 220 and 221 are merely illustrative and any hard or soft button or any other switch means for activating and inactivating the purge pre-set mode is contemplated within the scope of this invention. The buttons 220 and 221 are shown within the screen 51 on a particular frame of the display, but could be suitably displayed on any frame or implemented as hard buttons on the panel 52. Upon activation of button 220, a suitable frame will appear on the screen 51 to allow operator selection of purge options.

Figure 4:
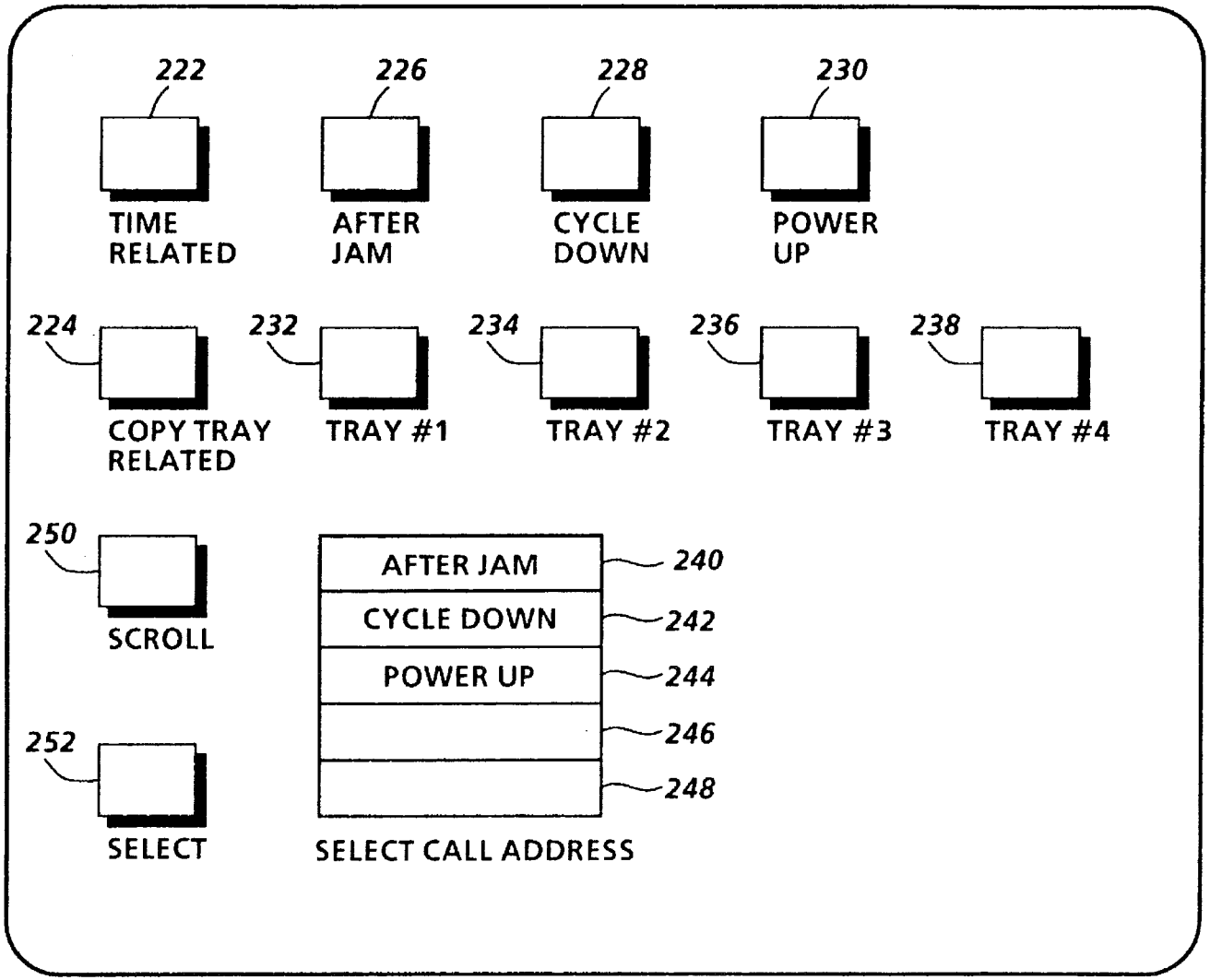
FIG. 4 is a screen display illustrating the selection of the copy sheet purge feature in accordance with the present invention.

With reference to FIG. 4, a suitable frame is shown, including time related options at button 222 and copy tray related options at button 224. As shown there are three time related options, in particular, time after the jam illustrated at button 226, the time period from cycle down shown as button 228, and the time period from the time of power up as shown at button 230. In one embodiment there could be included a preferred or default time for each of the time related conditions. Thus, there will be a time "X" for the after jam time period, a time "Y" for the time period after cycle down, and time period "Z" for the time period after a power up. It should be noted that the time periods are the limits or thresholds after which for the given event, the machine will automatically enter into a copy sheet purge cycle. The purge cycle will deplete the machine of a set number of copy sheets to avoid various unacceptable copy quality conditions such as fuser oil on the copy sheets or toner depletion on the copy sheets.

Button 224 relates to copy tray conditions such as the presence of a copy sheet at the pre-feed roll at the particular copy source or tray. Thus by activation of button 232 referencing tray number 1, after a given selected time period such as cycle down, the system will check for the presence of a copy sheet at the tray number 1 pre-feed location. If a copy sheet is sensed at the tray 1 pre-feed location, then that particular copy sheet will assumed to be unacceptable and will be purged from the machine to a purge tray. In a similar manner, the operator can select tray number 2 at button 234 and tray number 3 at button 236. Button 238 provides the option to select all trays to be monitored for purging of sheets.

In accordance with another aspect of the present invention, the default times for each of the timing events can be changed from the display screen. Thus, slots 240, 242, and 244 illustrate the after jam, cycle down, and power up events in window 254. By use of the scroll button 250 and select button 252, the operator is able to scroll through the various events with one of the slots being a highlighted slot, for example slot 240. With a given event in the highlighted slot, by selecting that particular event, the operator then using the user interface numerical keys or any other suitable numerical entry device, enters a new time period related to that particular event. Various other slots such as 246 and 248 can be used for other events, for example a particularly selected tray could be selected for purging 1, 2, or 3 copy sheets as selected.

It should be understood that the embodiment as described is illustrative and the scope of the invention is intended to cover various other events and time periods for triggering an automatic purge of copy sheets to a purge tray. For example, a purge could be related to the temperature of the fuser and the operator provided with the option to set various temperatures for the fuser to trigger an automatic purge. Thus a particular machine can be adapted to a particular environment to tailor a purge cycle to a particular machine in a particular environment. Many factors, such as the type and length of copy runs could easily dictate a change of conditions and a more desirable automatic purge configuration. It should also be understood that the various tray and time conditions are generally set in nonvolatile memory and routinely scanned by the control during the operation of the machine. It should also be understood that various options could be exclusive to a service representative rather than to a machine operator to preclude any unnecessary tampering with the purge conditions.

Although many scenarios could be described with reference to the present invention, a specific embodiment will now be described to illustrate the operation of the control once a purge operation has been configured. In a specific embodiment, if the machine is in the standby or cycle down state for a period longer than a given time in a nonvolatile timer, then there is a purge of all copy sheets currently in a pre-fed state in the copy sheet feed heads at cycle up. In the case where a machine does not have a high-capacity feeder (HCF) or there is an HCF present but less than 3 sheets pre-fed, there will be a purge of any pre-fed sheets and extra sheets from a selected tray to purge 3 sheets in total, to remove fuser oil residue. If the machine is not in standby, but rather is powered off and on, then there will be a purge of all pre-fed sheets at the first cycle up after the machine is powered on. In the case where a machine does not have an HCF or there is an HCF present but less than 3 sheets pre-fed, there will be a purge of any pre-fed sheets and extra sheets from the selected tray to purge 3 sheets in total to remove the fuser oil residue. Thus 3 sheets are purged in any case to remove fuser oil residue. In addition, assuming at least 4 copy sheet trays, there may be the requirement of a purge of 4 sheets if each of the copy sheet trays has a sheet at the pre-feed station.

Figure 5:
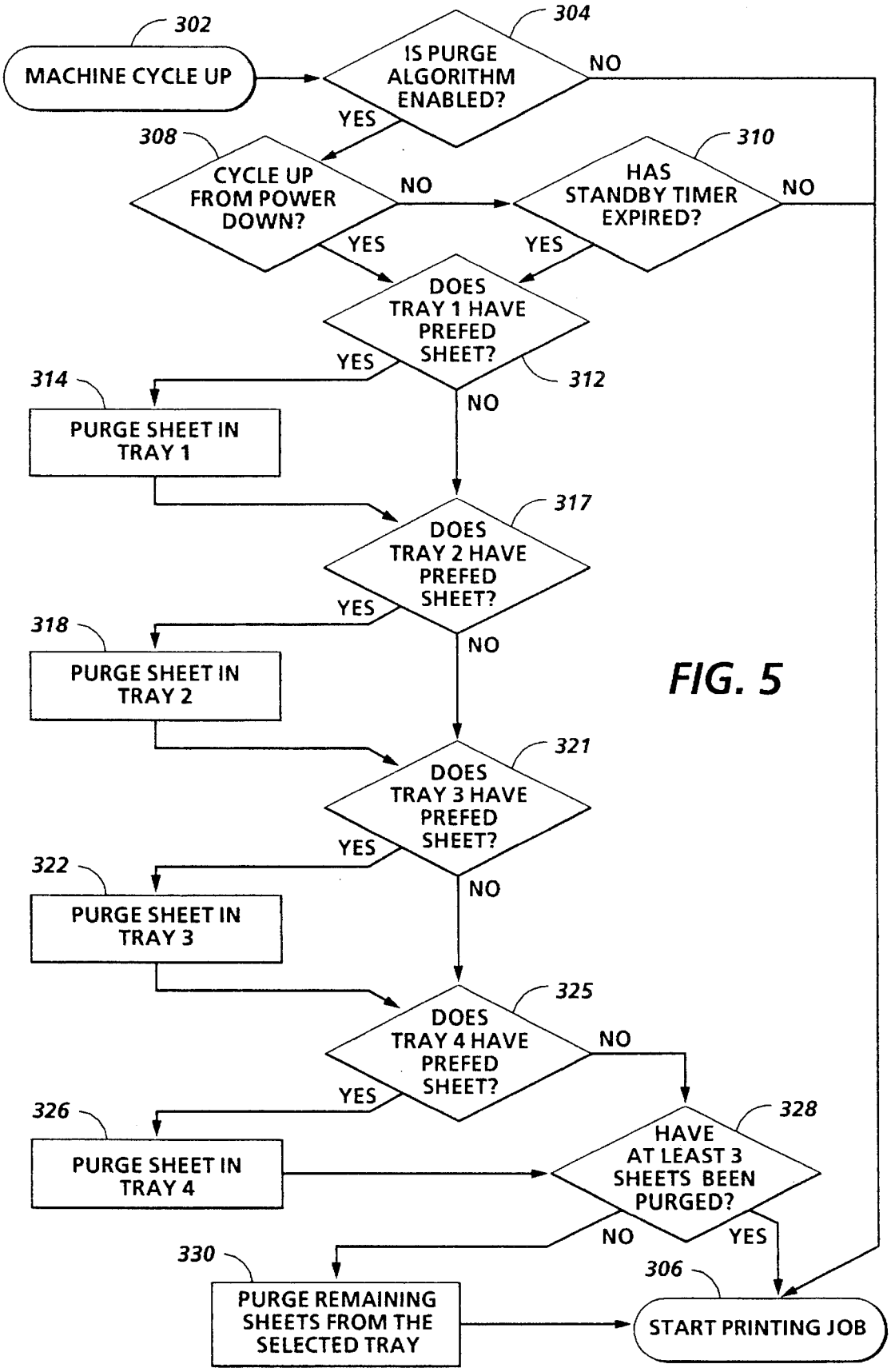
FIG. 5 illustrates a flowchart of the copy sheet purge feature in accordance with the present invention.

This scenario is further illustrated in the flowchart in FIG. 5. Machine cycle up is shown at block 302 and there is an initial determination at block 304 whether or not the purge algorithm is enabled. If not, the printing job is started as illustrated at block 306. If on the other hand the purge algorithm is enabled, there is a determination whether or not the machine has cycled up from a power down at block 308. If not, there is a determination as to the nonvolatile memory timer at block 310. If the timer has not expired, then there is a start print again as illustrated at 306.

If on the other hand, there is either a cycle up from power down or the standby timer has expired, then at block 312 there is a determination as to whether or not tray 1 has a pre-fed sheet. If yes, there is a purge of the pre-fed sheet in tray 1 as shown in block 314. If tray 1 does not have a pre-fed sheet then, trays 2, 3, and 4 are then checked in sequence. If either tray 2, tray 3, or tray 4, has a pre-fed sheet at the pre-feed station blocks 317, 321, and 325, then the copy sheet at the pre-feed station is purged as illustrated at blocks 318, 322, and 326. It can be seen that if there is a copy sheet in each at the pre-feed station in each of the trays, a minimum of 4 sheets will be purged one from each tray. Finally, there is a determination if at least at 3 sheets have been purged as illustrated at block 328. If at least 3 of the 4 trays have copy sheets in the pre-feed location, then at least 3 sheets will have been purged and as illustrated in FIG. 5 the routine cycles to the start print job shown at block 306. However, if 3 sheets have not been purged, then as illustrated at block 330, there will be purged sufficient sheets to equal 3 sheets purged from the selected tray. For example, if there are no copy sheets in a pre-feed station or copy sheets in only one or two of the four trays, then at the decision block 328 there will have only been at most two copy sheets purged from the system. It will then be necessary to purge additional copy sheets. The source of the additional copy sheets to be purged is merely the selected copy sheet tray needed to run the particular production job. Thus, if tray 3 has been the selected tray to complete the job run, no matter what particular tray provided a purged copy sheet, any additional copy sheets to be purged to provide at least 3 purged copy sheets will be from tray 3. Upon purging remaining sheets from the selected tray as illustrated at block 330, the system is ready to begin the job requirement as illustrated at block 306.

In general, it should be noted that the invocation or enabling of the purge features may be the option of the manufacturer, the service arm of the manufacturer, or the customer. This would be dependent upon the specific system and its capabilities, and also whether the features are implemented in hardware, software, or a combination of both. The manufacturer may elect to provide the invocation of the features on a special order basis. That is, the customer would be able to order the machine from the factory with or without the features implemented.

The customer service person may have access to various system parameters not normally available to the customer or operator. In that case, the feature may be invoked by the service person. This should not preclude other means of non-customer access to system parameters, such as through a remote interactive billing or monitoring connection. The customer may have the ability to select invocation of the features by means of the normal user interfaces to the system, e.g. the control panel, user interface, a local terminal, or remotely. Note that in certain systems only one of the problem effects may be present. This should not preclude application of the features to solve either or any problem relating to system idle time. Some systems may not use a pre-feed position in the paper supply trays and may not exhibit copy quality defects because of paper remaining in the trays during system idle time, but may have a problem with fuser lubricant contamination.

Sheets are purged from the system to minimize the probability of certain copy or print defects from occurring in the job output. Purged sheets could be directed to an output designated for scratch sheets or any other designated output of the system. If only one output direction is available, the purged sheets may be on the bottom of the output stack.

Various system parameters are monitored to determine when and which sheets are to be purged. The selection of system parameters to be monitored and controlled would be dependent upon the specific system and its capabilities, whether the features are implemented in hardware, software, or a combination of both. This would also determine who selects the parameters and their characteristics. The typical case would probably be the customer service person, either locally or remotely. Set points of these parameters would be variable, dependent upon the specific system and its capabilities, whether the features are implemented in hardware, software, or a combination of both. This would also determine who selects the set points. The typical case would probably be the customer service person, either locally or remotely.

When to purge sheets would be determined by monitored selected available parameters relative to system idle time. These parameters could include such parameters directly related to time, such as a real-time clock, or built-in timers related to internal system functions such as a ROS time-out timer, or a built-in timer specifically designed to control invocation of the purge. Parameters indirectly related to real-time could also be monitored. An example would be fuser temperature. In systems without a real-time clock, the amount of time that a system sat idle with power off could be determined by the temperature of the fuser at the time of next power up. If the system was powered off for only a short length of time the amount of temperature drop would be minimal, thus indicating that a purge would not be necessary. Set points of both direct and indirect parameters may be affected by environmental conditions (temperature and humidity) and materials used (paper stock). Which sheets to purge would be determined by the type of system and its configuration.

While there has been illustrated and described what is at present considered to be a preferred embodiment of the present invention, it will be appreciated that numerous changes and modifications are likely to occur to those skilled in the art, and it is intended to cover in the appended claims all those changes and modifications which fall within the true spirit and scope of the present invention.

We claim:

1. In an image processing apparatus having a xerographic process for producing images on copy sheets, the apparatus including a plurality of copy sheet sources with copy sheet pre-feed locations, a copy sheet drive, a purged copy sheet location, and a controller for directing the xerographic process, the controller including a timer for determining the length of machine down time, a method of purging copy sheets from the apparatus comprising the steps of:

monitoring the timer for a given length of image processing apparatus down time;

detecting by the controller said given length of image processing apparatus down time;

checking the copy sheet pre-feed locations to determine the presence of copy sheets;

responding to the detection of said given length of image processing apparatus down time and the presence of copy sheets at the pre-feed locations to operate the copy sheet drive, and responsive to the copy sheet drive purging copy sheets from the copy sheet pre-feed locations to the purged copy sheet location.

2. The method of claim 1 including the step of inhibiting the step of responding to the detection of said given length of image processing apparatus down time and the presence of copy sheets at the pre-feed locations to operate the copy sheet drive.

3. In an image processing apparatus having a xerographic process for producing images on copy sheets, the apparatus including a copy sheet source, a copy sheet drive, a purged copy sheet location, and a controller for directing the xerographic process, the controller including a timer for determining machine operation time periods, a method of purging copy sheets from the apparatus comprising the steps of:

monitoring the timer for a given time period;

detecting by the controller said given time period;

responding to the detection of said given time period to operate the copy sheet drive, and in response to the operation of the copy sheet drive, purging copy sheets to the purged copy sheet location.

4. The method of claim 3 wherein said given time period is related to apparatus inactivity.

5. The method of claim 3 wherein said given time period is a measure of elapsed time after completion of a job run.

6. The method of claim 3 wherein said given time period is a measure of apparatus standby time.

7. In an image processing apparatus having a xerographic process for producing images on copy sheets, the apparatus including a plurality of copy sheet sources, a copy sheet drive, a purged copy sheet location, and a controller for directing the xerographic process, a method of purging copy sheets from the apparatus comprising the steps of:

monitoring the timer for a given time period;

detecting by the controller said given time period;

checking the copy sheet sources for the presence of a copy sheet;

responding to the detection of said given time period and the checking of the copy sheet sources to operate the copy sheet drive, and in response to the operation of the copy sheet drive, purging copy sheets to the purged copy sheet location.

8. The method of claim 7 wherein a copy sheet to be purged is a copy sheet at a predetermined location.

9. The method of claim 8 wherein the predetermined location is a copy sheet source pre-feed roll.

10. The method of claim 7 wherein the step of purging copy sheets to the purged copy sheet location includes the step of purging a given number of copy sheets.

11. The method of claim 10 wherein the step of purging a given number of copy sheets depends upon the number of copy sheet sources having the presence of a copy sheet.

12. In an image processing apparatus having a xerographic process for producing images on copy sheets, the apparatus including a plurality of copy sheet sources, a copy sheet drive a purged copy sheet location, and a controller for directing the xerographic process, a method of purging copy sheets from the apparatus comprising the steps of:

monitoring the xerographic process for a given xerographic parameter including a timing parameter;

detecting said given xerographic parameter;

responding to the detection of said given xerographic parameter to operate the copy sheet drive, and in response to the operation of the copy sheet drive purging the copy sheets to the purged copy sheet location.

13. The method of claim 12 wherein the xerographic parameter is a temperature parameter.

14. The method of claim 12 wherein the xerographic parameter is a copy sheet location parameter.

15. The method of claim 12 wherein the step of purging copy sheets to the purged copy sheet location includes the step of purging a variable number of copy sheets depending upon the xerographic parameter.

16. The method of claim 12 wherein the step of purging copy sheets to the purged copy sheet location depends upon a plurality of xerographic parameters.

17. The method of claim 16 wherein the plurality of xerographic parameters includes a timing parameter and a location parameter.

18. The method of claim 16 wherein the controller includes a non-volatile memory and wherein the plurality of xerographic parameters are selectively set in non-volatile memory.

19. The method of claim 12 including a step of inactivating the step of monitoring the xerographic process for a given xerographic parameter.

20. An image processing apparatus having a xerographic process for producing images on copy sheets, the apparatus including a plurality of copy sheet sources, a copy sheet drive, a purged copy sheet location, a controller for directing the xerographic process, a device for monitoring the xerographic process for a given xerographic parameter the xerographic parameter including a temperature parameter; a detector for recognizing said given xerographic parameter; means for responding to the detection of said given xerographic parameter to operate the copy sheet drive, and means responsive to the copy sheet drive for purging copy sheets to the purged copy sheet location.

21. The apparatus of claim 20 wherein the means for purging copy sheets to the purged copy sheet location includes means for purging a variable number of copy sheets depending upon the xerographic parameter.

22. The method of claim 20 wherein the control includes a non-volatile memory and wherein the xerographic parameter is selectively set in non-volatile memory.

23. The apparatus of claim 20 wherein the xerographic parameter is a timing parameter.

24. The apparatus of claim 20 wherein the xerographic parameter is a copy sheet location parameter.

25. The apparatus of claim 20 wherein the means for purging copy sheets to the purged copy sheet location depends upon a plurality of xerographic parameters.

26. The apparatus of claim 20 wherein the plurality of xerographic parameters includes a timing parameter and a location parameter.

27. The apparatus of claim 20 including means for inactivating the device for monitoring the xerographic process for a given xerographic parameter.

* * * * *